US009333612B2

(12) United States Patent
Dovel

(10) Patent No.: US 9,333,612 B2
(45) Date of Patent: May 10, 2016

(54) TOOL SHARPENER WITH ADJUSTABLE SUPPORT GUIDE

(71) Applicant: Darex LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 64 days.

(21) Appl. No.: 14/290,613

(22) Filed: May 29, 2014

(65) Prior Publication Data

US 2015/0343591 A1 Dec. 3, 2015

(51) Int. Cl.

| | |
|---|---|
| ***B24B 3/54*** | (2006.01) |
| ***B24B 3/36*** | (2006.01) |
| ***B24B 23/06*** | (2006.01) |
| ***B24B 23/00*** | (2006.01) |

(52) U.S. Cl.

CPC ..... *B24B 3/36* (2013.01); *B24B 23/005* (2013.01); *B24B 23/06* (2013.01)

(58) Field of Classification Search

CPC ..... B24B 3/54; B24B 23/06; B24B 3/00

USPC ..... 451/349, 296, 310, 45

See application file for complete search history.

(56) References Cited

U.S. PATENT DOCUMENTS

| | | | | |
|---|---|---|---|---|
| 2,249,218 | A * | 7/1941 | Meade | B24D 15/081 451/486 |
| 4,964,241 | A * | 10/1990 | Conklin | B24B 21/002 451/241 |
| 8,696,407 | B2 * | 4/2014 | Dovel | B24B 3/52 451/296 |
| 8,784,162 | B1 * | 7/2014 | Dovel | B24B 3/54 451/303 |
| 8,944,894 | B2 * | 2/2015 | Smith | B24D 15/081 451/196 |
| 2004/0198198 | A1 * | 10/2004 | Friel, Sr. | B24D 15/065 451/198 |
| 2008/0261494 | A1 * | 10/2008 | Friel | B24B 3/54 451/45 |
| 2011/0201257 | A1 * | 8/2011 | Walker | B24B 3/54 451/45 |

* cited by examiner

*Primary Examiner* — Robert Rose

(74) *Attorney, Agent, or Firm* — Hall Estill Attorneys at Law

(57) ABSTRACT

Apparatus for sharpening a cutting tool. In some embodiments, a tool sharpener is provided with a flexible abrasive medium having an abrasive surface and arranged along a planar extent. A guide assembly has a guide frame, a cam surface, and a pivotal guide member. A guide surface on the guide member extends at a selected angle with respect to the planar extent of the medium to support a first side of the tool during presentation of a second side and cutting edge of the tool against the abrasive surface along the planar extent. A cam follower contactingly engages the cam surface to establish the selected angle. A biasing mechanism applies a biasing force to urge the guide surface to pivot toward the planar extent to maintain the cam follower in contact with the cam surface.

20 Claims, 9 Drawing Sheets

TOOL SHARPENER WITH ADJUSTABLE SUPPORT GUIDE

BACKGROUND

Cutting tools are used in a variety of applications to cut or otherwise remove material from a workpiece. A variety of cutting tools are well known in the art, including but not limited to knives, scissors, shears, blades, chisels, spades, machetes, saws, drill bits, etc.

A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use. It can thus be desirable to subject a dulled cutting tool to a sharpening operation to restore the cutting edge to a greater level of sharpness. A variety of sharpening techniques are known in the art, including the use of grinding wheels, whet stones, abrasive cloths, etc. While these and other sharpening techniques have been found operable, there is a continued need for improvements in the manner in which various cutting tools may be sharpened.

SUMMARY

Various embodiments of the present disclosure are generally directed to an apparatus for sharpening a cutting edge of a tool.

In some embodiments, a tool sharpener is provided with a flexible abrasive member having an abrasive surface arranged along a planar extent. A guide assembly is provided adjacent the planar extent of the medium, the guide assembly having a guide frame, a cam surface selectively positionable with respect to the guide frame, and a guide member pivotally mounted to the guide frame. The guide member has a guide surface extending along a guide plane at a selected angle with respect to the planar extent of the medium to support the first side of the tool during presentation of the second side and the cutting edge of the tool against the abrasive surface of the medium along the planar extent. The guide member further has a cam follower which contactingly engages the cam surface to establish the selected angle in relation to the selected position of the cam surface. A biasing mechanism applies a biasing force to urge the guide surface to pivot toward the planar extent to maintain the cam follower in contact with the cam surface.

These and other aspects of various embodiments of the present disclosure will become apparent from a review of the following detailed description in conjunction with the accompanying drawings.

DETAILED DESCRIPTION

Figure 1:
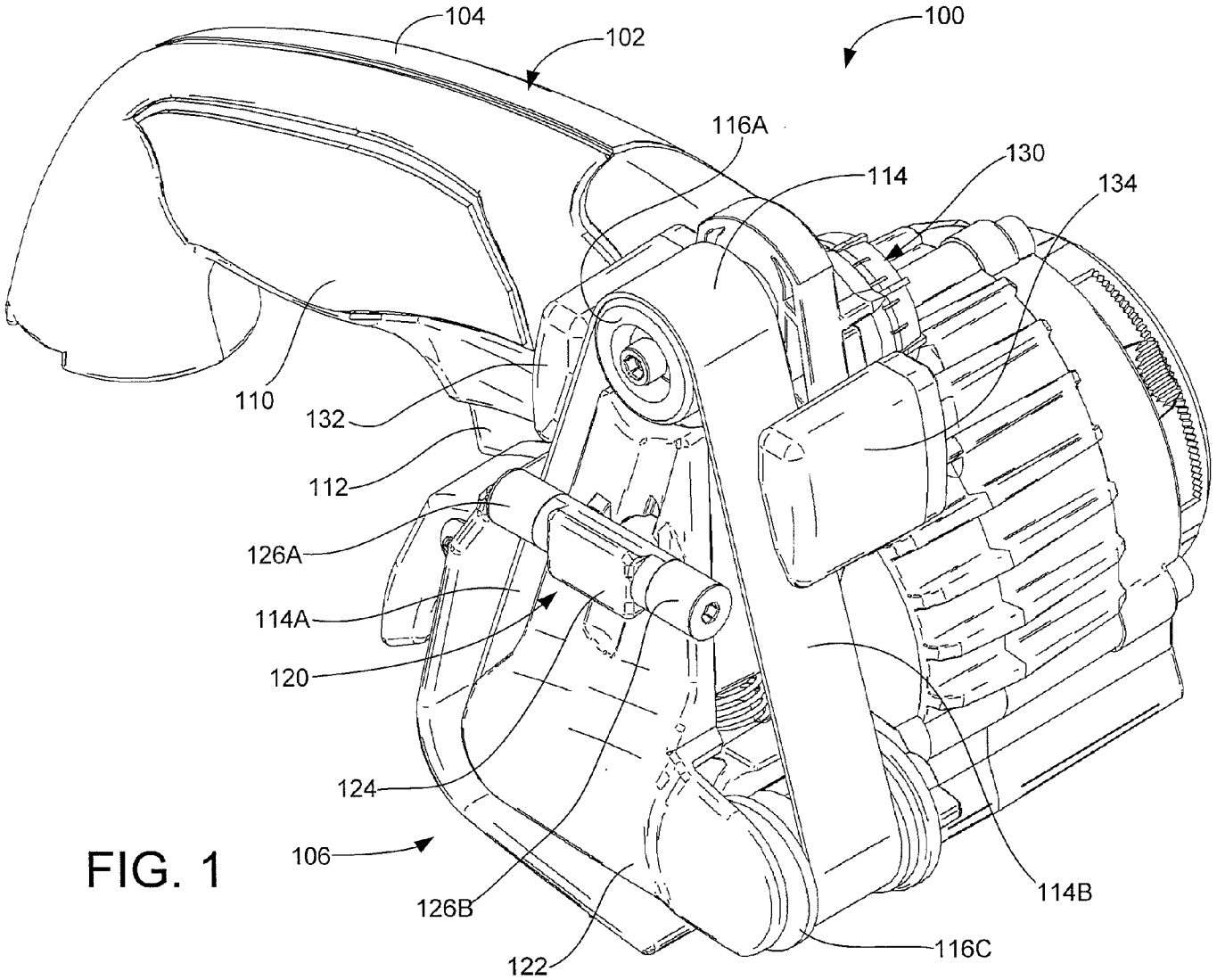
FIG. 1 is an isometric depiction of a tool sharpener constructed in accordance with some embodiments of the present disclosure.
Figure 2A:
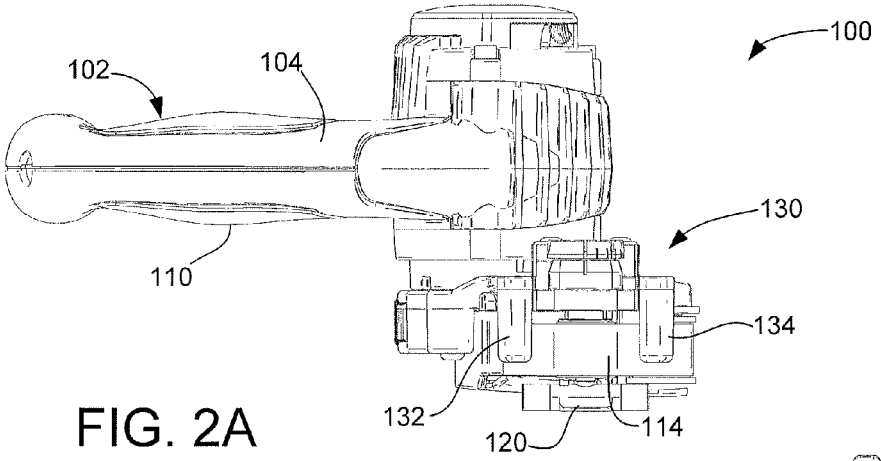
FIG. 2A is a top plan view of the tool sharpener of FIG. 1.

FIG. 1 shows an exemplary tool sharpener 100 constructed in accordance with some embodiments of the present disclosure. The tool sharpener 100 is configured to sharpen a variety of tools with different configurations of cutting edges. Additional views of the tool sharpener 100 are provided in FIGS. 2A-2C. The tool sharpener 100 is characterized as a hand-held powered sharpener.

The tool sharpener 100 includes a base structure 102 which encloses and/or supports various components of interest. The base structure 102 includes a main body 104 and a sharpening attachment assembly 106. The sharpening attachment assembly 106 can be removably mated with the main body 104 to facilitate various sharpening operations described below. As desired, other operable attachments (not separately shown) can be installed on the main body 104 to carry out other motor-driven functions.

The main body 104 is adapted to be securely placed on a base surface 108 (FIG. 2B) or, alternatively, to be picked up and supported by a user of the tool sharpener 100. A handle 110 has a user grip surface adapted to be grasped by a hand of the user. A trigger assembly 112 can be selectively depressed to energize a motor (not separately shown) disposed within the main body 104. An electrical power cord (also not separately shown) can extend from an end of the main body 104 to supply electrical power for use by the sharpener 100.

The motor is used to drive an abrasive member 114 during a sharpening operation. The abrasive member 114 is characterized as an endless abrasive belt, but such is merely exemplary and is not limiting as other forms of flexible abrasive media can be used, including stationary (e.g., non-motor driven) media.

The belt 114 is routed along a belt path that passes adjacent rollers 116A, 116B and 116C. A spring-biased tensioner assembly 118 coupled to roller 116C applies a tension force to the abrasive member (hereinafter, "belt") 114. This forms two planar extents 114A, 114B that extend between rollers 116A-116B and 116A-116C, respectively. The planar extents 114A, 114B are best viewed in FIG. 2C. The planar extents are nominally maintained along respective neutral planes except when deflected during a sharpening operation through contact with the cutting edge of a tool, as discussed below.

Figure 2B:
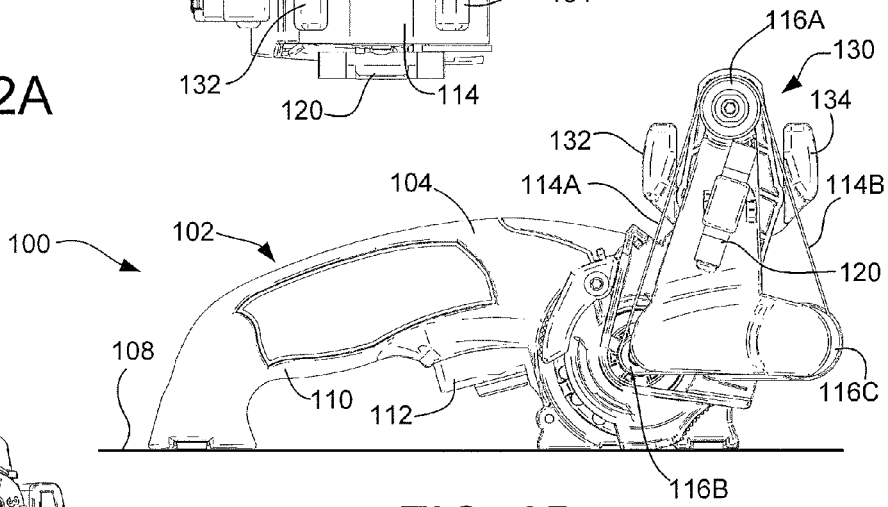
FIG. 2B is a front side elevational view of the tool sharpener.

A rotatable edge guide 120 includes a main body 122 rotatable with respect to a base structure plate 124 of the attachment 106 between a deployed position (FIGS. 1 and 2A) and a retracted position (FIG. 2B). The main body 122 supports a pair of edge guide roller members 126A, 126B. Each of the roller members 126A, 126B is configured to contactingly support, via rolling contact, an edge guide of a cutting tool during a sharpening operation while the rotatable edge guide 120 is in the deployed position. It will be appreciated that while the rotatable edge guide 120 can beneficially provide support during a sharpening operation, the guide 120 is not necessarily required and is therefore omitted in alternative embodiments.

An adjustable sharpening guide assembly 130 is used to provide lateral support to the respective sides of the cutting tool during a sharpening operation. The adjustable sharpening guide assembly 130, hereinafter also referred to as the "guide assembly," is shown in a detached fashion in the rearward facing view of FIG. 2C and the forward facing views of FIGS. 3A and 3B.

The guide assembly 130 includes a pair of opposing guide members 132, 134 each having an associated guide surface 136, 138 aligned along a respective guide plane. As explained below, the guide members 132, 134 are selectively adjustable to align the surfaces 136, 138 at different acute angles with respect to the respective planar extents 114A, 114B of the belt 114.

Figure 4:
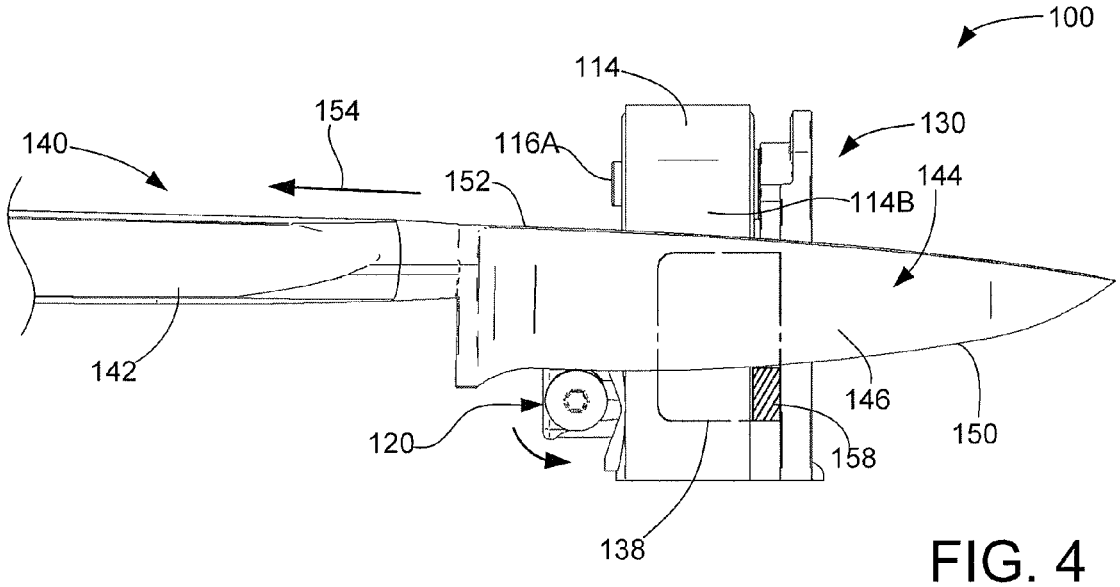
FIG. 4 depicts a sharpening operation upon an exemplary cutting tool using a selected guide member and the rotatable edge guide of FIG. 3A.
Figure 5:
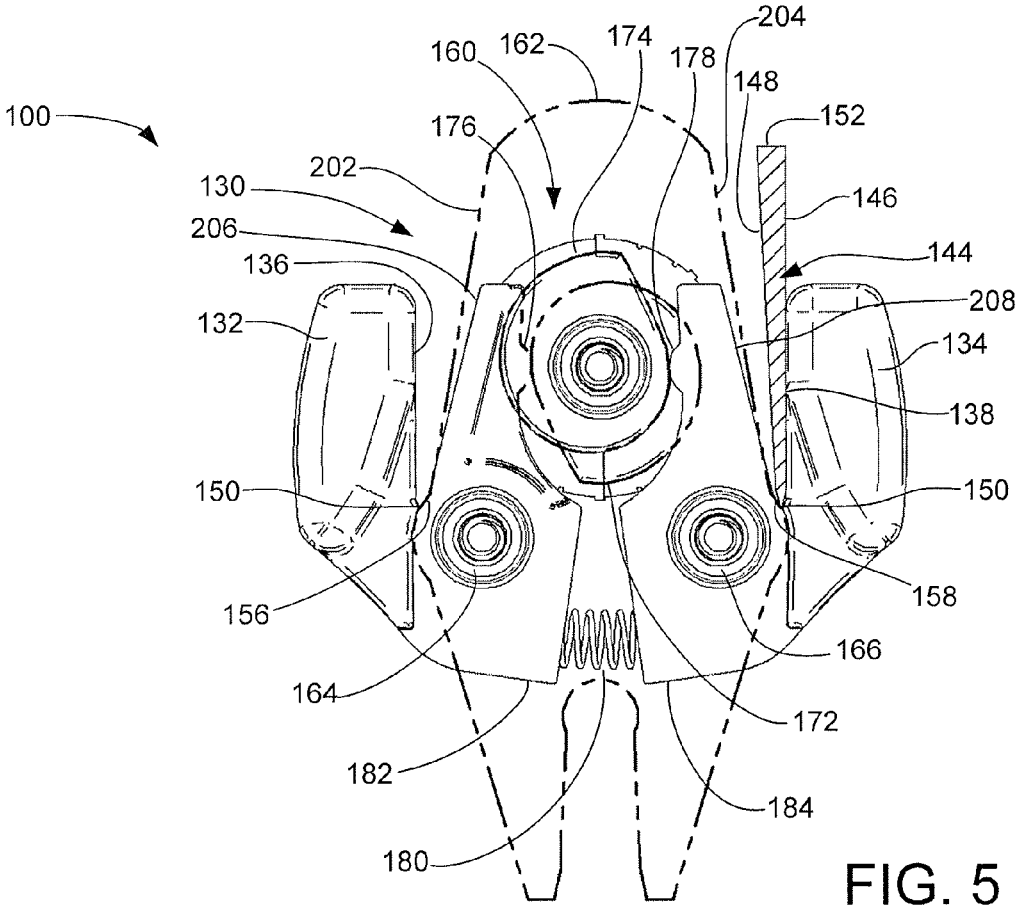
FIG. 5 is a partially cut-away, front-side view of a sharpening guide assembly of the tool sharpener.

FIG. 4 is a side view illustrate of a sharpening operation upon an exemplary cutting tool 140 using the rotatable edge guide 120 and the adjustable sharpening guide assembly 130. FIG. 5 is a partial cut-away front view of the same sharpening operation.

The tool 140 is characterized as a kitchen knife with a handle 142 and a blade portion 144 extending from the handle. The blade portion 144 includes opposing first and second side surfaces 146, 148, a curvilinearly extending cutting edge 150 and a top edge opposite the cutting edge.

The first side surface 146 of the knife 140 is contactingly aligned against the guide surface 138 of sharpening guide 134, and the second side surface 148 and the cutting edge 150 of the knife 140 are presented in contacting engagement against the abrasive surface of the belt 114 along planar extent 114B. Some displacement of the belt 114 out of the neutral plane established by the planar extent may take place in a manner explained below.

To carry out the sharpening operation, the user inserts the knife 140 adjacent the guide member 134 and draws the knife 140 back along retraction path 154 to successively present substantially the entire length of the cutting edge 150 against the abrasive surface. During such retraction, the cutting edge 150 may be supported by the rotatable edge guide 120.

Figure 3A:
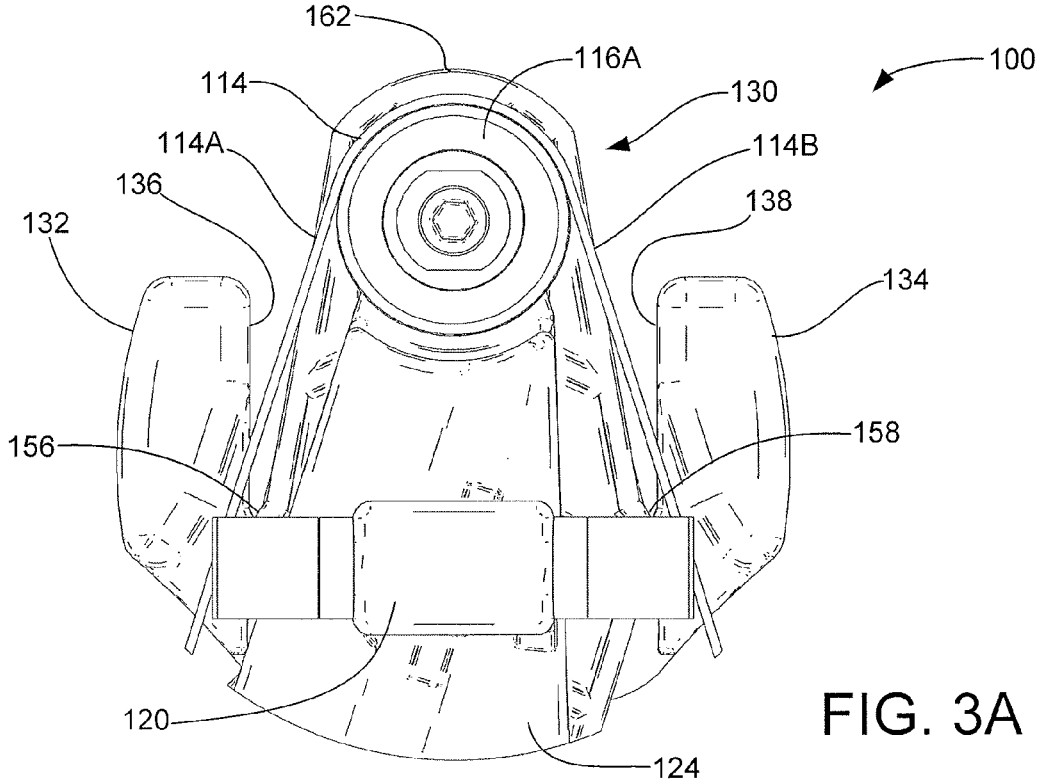
FIGS. 3A and 3B show a rotatable edge guide of the tool sharpener in a deployed position and in a retracted position, respectively.
Figure 3B:
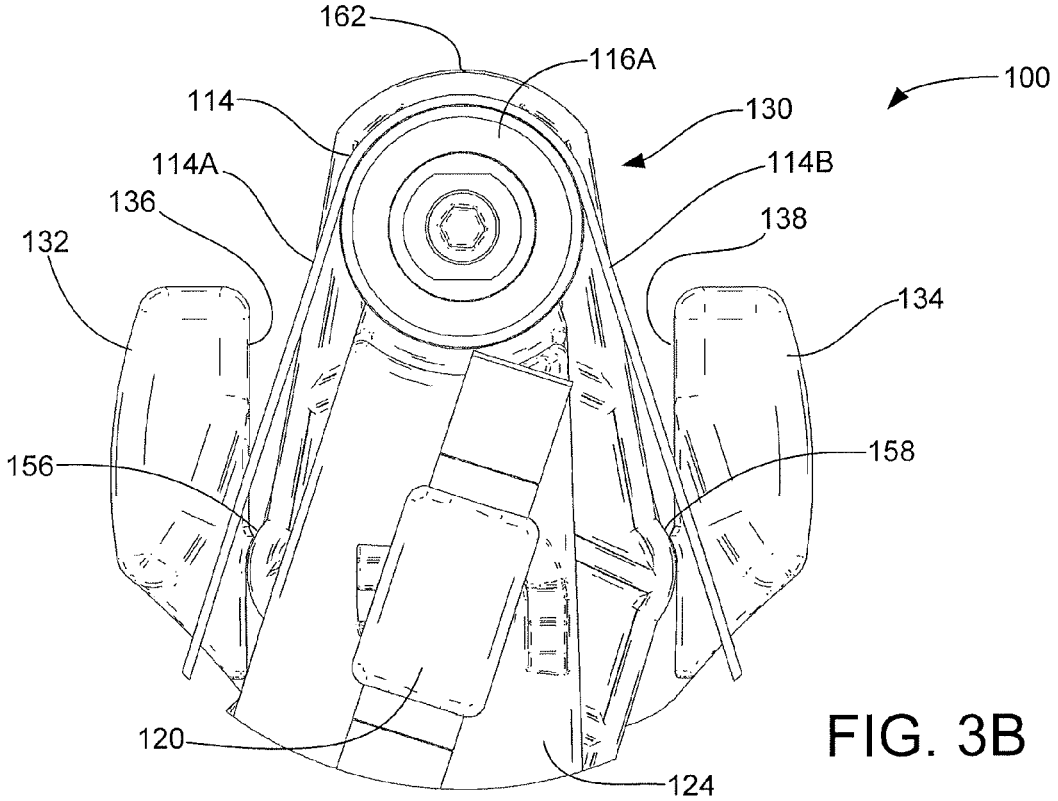

A stationary edge guide 158 of the guide member 134 opposite the rotatable edge guide 120 supports a distal extent of the cutting edge. A corresponding stationary edge guide 156 of the guide member 132 is shown in FIGS. 3A-3B and 5. The foregoing sequence can be repeated using the second guide member 132 to sharpen the opposing side of the knife 140.

The guide surfaces 136, 138 serve to establish the presentation angle of the tool 140 against the respective planar extents of the belt 114. This presentation angle is nominally the same for both guide surfaces, and can be adjusted using a dual cam mechanism 160 of the adjustable sharpening guide assembly 130 as will now be discussed beginning with FIGS. 6A-6B.

Figure 2C:
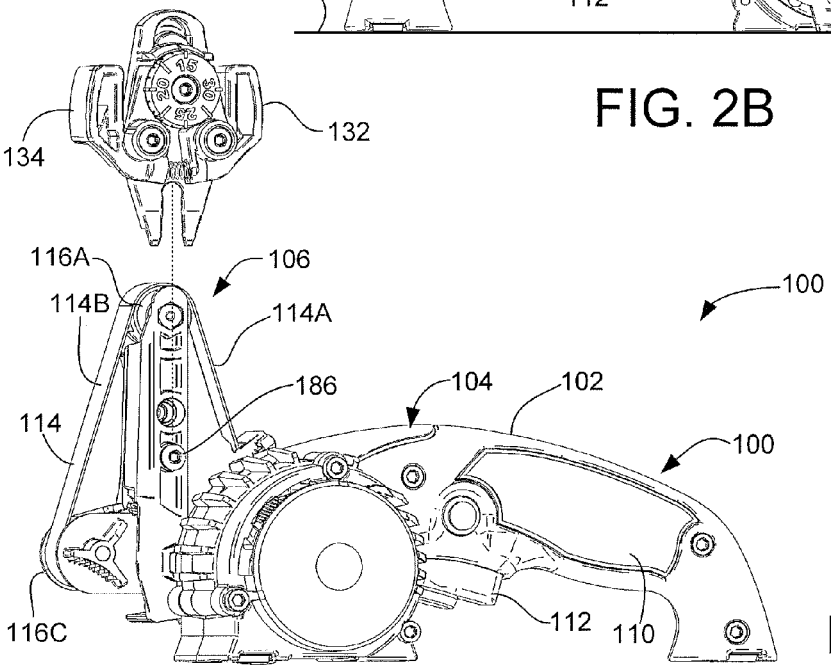
FIG. 2C is a back side, partially exploded elevational view of the tool sharpener.
Figure 6A:
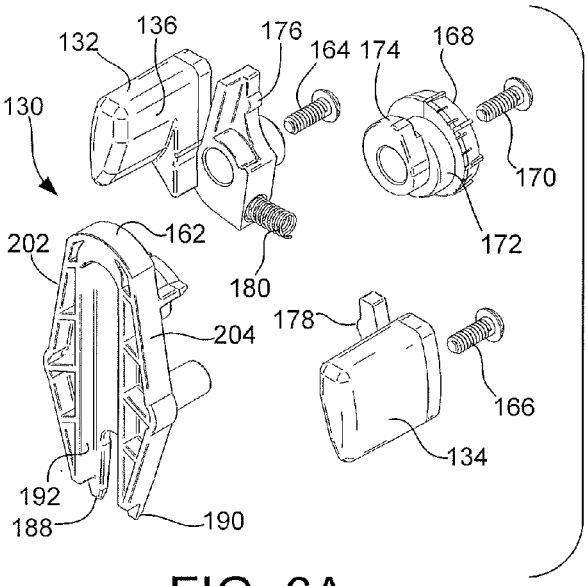
FIG. 6A is an exploded view of the sharpening guide assembly.
Figure 6B:
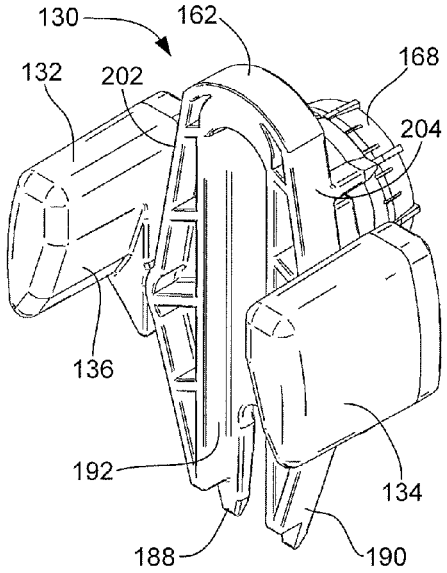
FIG. 6B is an isometric view of the assembled sharpening guide assembly.

FIG. 6A provides an exploded isometric view of the guide assembly 130, and FIG. 6B provides an assembled isometric view of the guide assembly. The guide assembly 130 includes a stationary guide frame 162 which is removably affixable to the attachment 106, as depicted in FIG. 2C. Removing the guide assembly 130 permits full access to the planar extents 114A, 114B of the belt 114 for certain types of grinding operations (e.g., sharpening a lawnmower blade, etc.).

The first and second guide members 132, 134 are pivotally mounted to the guide frame 162 about respective pivot points established by fasteners 164, 166. A user activated knob 168 is affixed to the guide frame 162 using a fastener 170 so that the knob 168 is selectively positionable (e.g., rotatable) by a user.

The dual cam mechanism 160 is formed from first and second cams 172, 174 and first and second cam followers 176, 178. The cams 172, 174 are affixed to the knob 168 and have eccentric cam surfaces along the outermost peripheries thereof. The cam followers 176, 178, also referred to as cam projections, extend from the first and second guide members 132, 134 to contactingly engage the cam surfaces. In this way, user rotation of the knob 168 concurrently adjusts the angle of both guide members 132, 134. For reference, FIG. 5 is a front-facing view so that the cams 172, 174 shown therein lie behind the guide plate 162.

A biasing mechanism 180 is further connected between lower leg portions 182, 184 of the respective first and second guide members 132, 134 (see FIG. 5). The biasing mechanism 180 is characterized as a coiled spring, although other forms of biasing mechanisms can be used including magnets, other forms of springs, etc. Generally, the biasing mechanism 180 applies a biasing force to each of the guide members 132, 134 to urge the associated guide surfaces 136, 138 to pivot toward the planar extents 114A, 114B to maintain the respective cam followers 176, 178 in contact with the associated cams 172, 174.

Figure 7A:
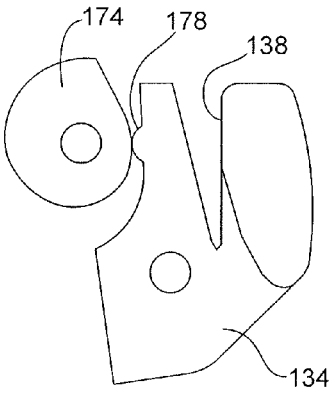
FIGS. 7A-7C show different selected angles of a guide member of the sharpening guide assembly.
Figure 7B:
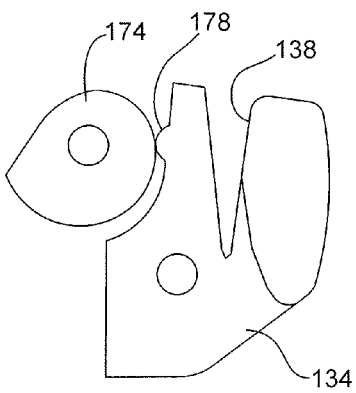
Figure 7C:
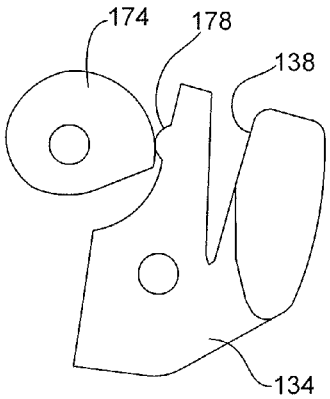

FIGS. 7A-7C show operation of the cam mechanism 160 for the guide member 134. Similar displacement is concurrently applied to the guide member 132. As in FIG. 5, the view orientation in FIGS. 7A-7C is from the front of the sharpener 100.

The rotational position of the cam 174 establishes the selected angle of the guide surface 138 with respect to the abrasive member 114. As the cam 174 rotates, the cam follower 178 moves in and out with respect to the center of the cam, inducing corresponding rotation of the guide member 134 about the pivot point established by fastener 166 (FIGS. 5, 6A). The biasing member 180 (FIG. 5) nominally maintains contacting engagement of the cam follower 178 against the cam 174, except as discussed below.

The movement of the guide member 134 is constrained over a predefined range, such as from about 15 degrees to about 30 degrees. Other ranges can be provided. FIG. 7A shows the guide surface 138 at a first angle of about 15 degrees with respect to the abrasive belt 114 (not separately shown). FIG. 7B provides a second angle of about 22.5 degrees, and FIG. 7C provides a third angle of about 30 degrees.

Figure 8A:
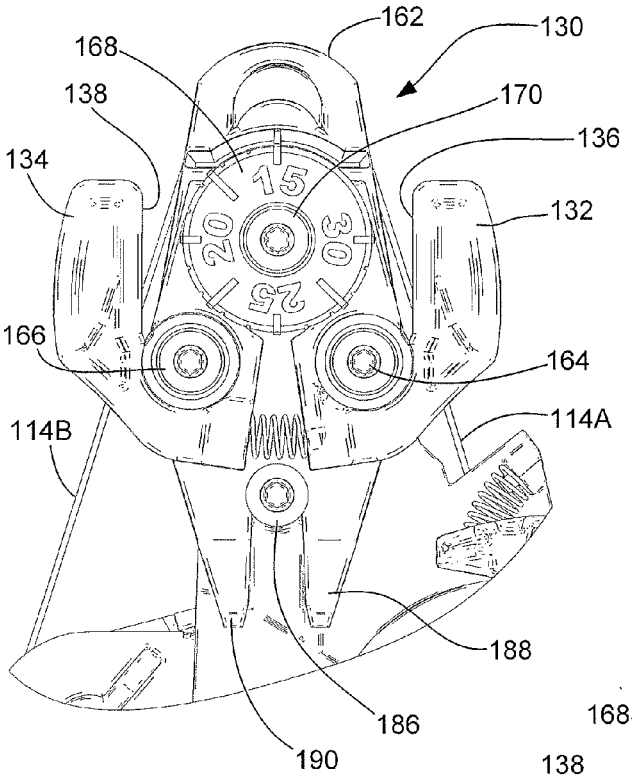
FIGS. 8A and 8B show different selected angles of the guide members of the sharpening guide assembly.
Figure 8B:
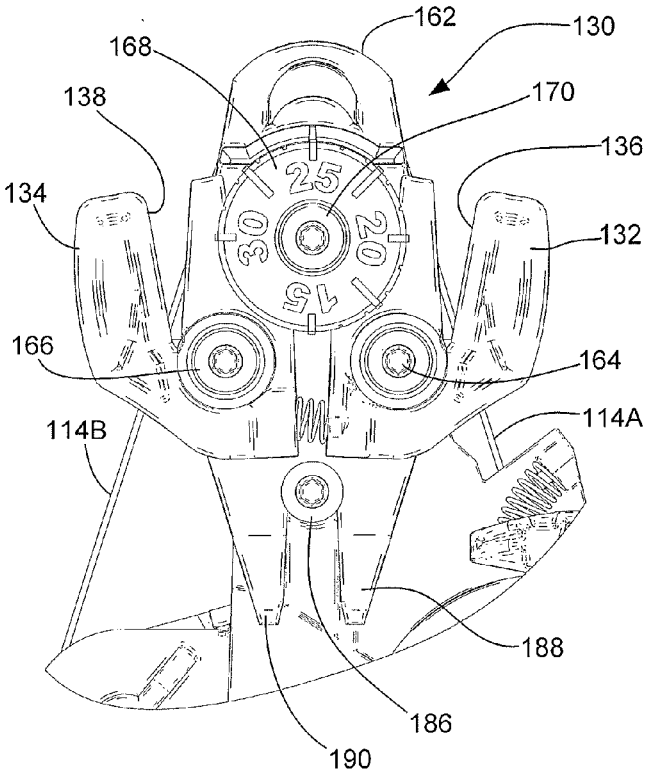

Printed indicia can be placed on the knob 168 to indicate to the user the selected angle of the guide surfaces. FIG. 8A is a rear facing view showing the guide assembly 130 at an angle of about 15 degrees, and FIG. 8B shows the guide assembly at an angle of about 25 degrees.

As mentioned above, the guide assembly 130 is configured to be removably attached to the tool sharpener 100. To install the guide assembly, a retention fastener 186 extending from the attachment 106 is nested within a u-shaped channel formed by opposing leg portions 188, 190 of the guide flange 162 and tightened to secure the guide assembly 130 to the sharpener 100. Alignment surfaces on the guide frame 162, such as rail surface 192 in FIG. 6B, can maintain the desired orientation of the guide frame on the sharpener.

With reference again to FIG. 5, the guide frame 162 (shown in broken line fashion) is further provided with opposing limit surfaces 202, 204 on opposing sides of the guide frame. The limit surfaces are arranged in facing relation to the first and second guide surfaces 136, 138, and are operable to automatically adjust the inward positional extent of a cutting tool during a sharpening operation as explained below.

Continuing with FIG. 5, the guide members 132, 134 include outwardly directed guide surfaces 206, 208 adjacent the limit surfaces 202, 204 to form substantially v-shaped insertion channels for each of the guide members. More specifically, a first v-shaped channel on the first guide member 132 is formed by guide surface 136, base surface 156 and guide surface 206; a second v-shaped channel on the second guide member 134 is formed by guide surface 138, base surface 158 and guide surface 208.

Figure 9A:
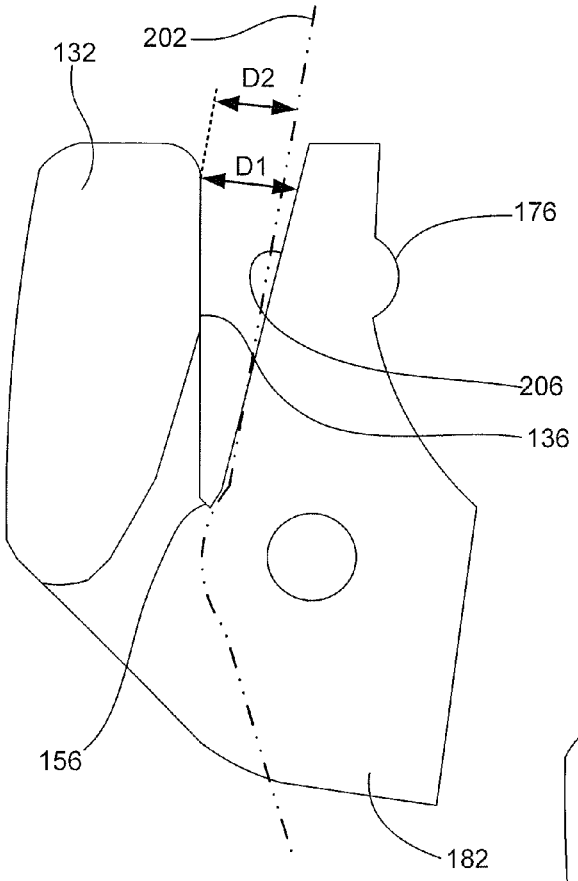
FIGS. 9A and 9B illustrate a relationship between a selected guide member and a limit surface of a guide frame of the sharpening guide assembly.
Figure 9B:
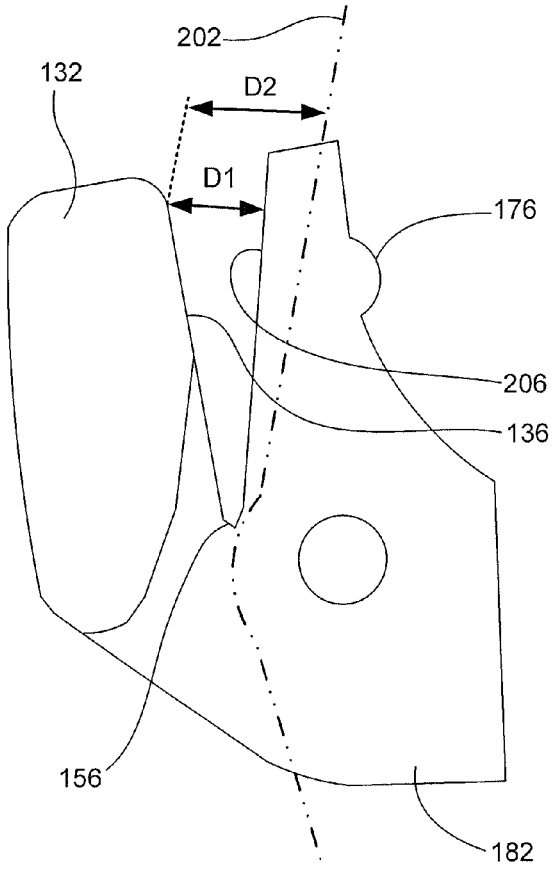

FIGS. 9A and 9B generally depict the guide member 132 in conjunction with the first limit surface 202 (shown in broken line fashion). A corresponding configuration is provided for the guide member 134. At their widest extent, the guide surfaces 136, 206 of the guide member 132 are separated by an overall (maximum) distance D1. The distance D1 remains fixed irrespective of the selected angle of the guide member 132.

A second distance D2 represents the overall distance between the guide surface 136 and the limit surface 202. The distance D2 is variable and is established in relation to the selected angle of the guide member 132; the distance D2 is reduced at smaller angles as in FIG. 9A, and is increased at larger angles as in FIG. 2B. It can be seen from a comparison of FIGS. 9A and 9B that for a range of smaller guide angles, the limit surface 202 is closer to the guide surface 136 than the guide surface 206 (e.g., D2<D1). For a range of larger guide angles, the limit surface 202 is farther from the guide surface 136 than the guide surface 206 (e.g., D2>D1). While not shown in the drawings, it will be understood that the two distances are nominally equal (D2=D1) at a selected intermediate angle (such as around 20 degrees).

Figure 10:
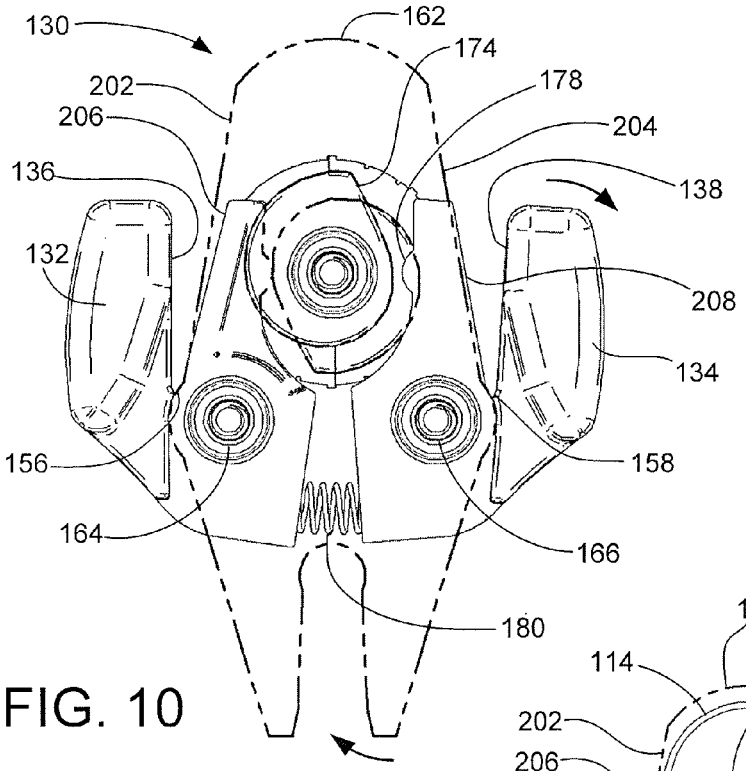
FIG. 10 shows the sharpening guide assembly with a deflected guide member.
Figure 11:
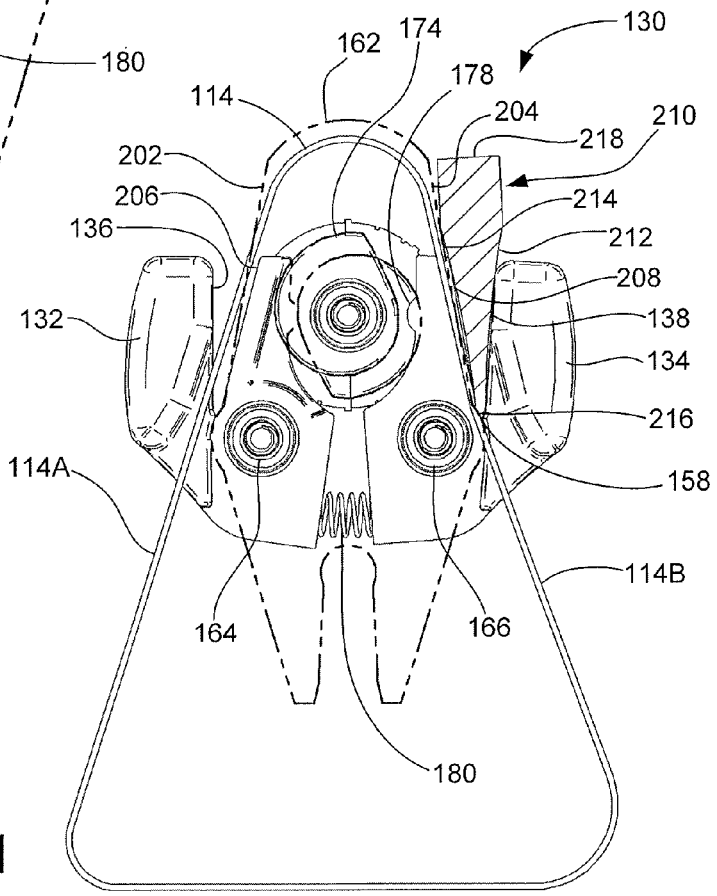
FIG. 11 illustrates use of the limit surface during a sharpening operation.

The limit surfaces 202 and 204 provide an automatic angle adjustment mechanism that automatically increases the presentation angle during the sharpening of certain types of cutting tools. FIGS. 10 and 11 illustrate the automatic rotation of the guide member 134 due to the insertion of a relatively wide cutting tool 210. Similar operation is provided for guide member 132. As before, FIGS. 10 and 11 are front side views of the sharpener 100. It will be appreciated that the tool 210 and the abrasive member 114 are included in FIG. 11, but these elements are omitted from FIG. 10 for clarity.

The tool 210 has a blade portion with opposing first and second side edges 212 and 214, cutting edge 216 and top edge 218. The first side surface 212 contactingly engages guide surface 138 of the guide member 134, and the second side surface 214 is oriented so as to be in facing relation to the abrasive belt 114. The tool 210 has a relatively large primary angle (e.g., the angle between the respective side surfaces 212, 214) such as on the order of around 20 degrees. For purposes of comparison, the tool 140 discussed above in FIGS. 4-5 is relatively thinner and has a smaller presentation angle on the order of around 10 degrees.

Generally, the tool sharpener 100 is configured to sharpen tools with relatively larger primary angles at relatively larger sharpening angles, such as at around 20 degrees or more. However, insertion of the tool 210 with the guide member 134 set to a lower angle, such as around 15 degrees, causes the inwardly facing, second side surface 214 to contactingly engage the limit surface 204 of the guide plate 162. This induces outwardly directed pivotal movement (rotation) of the guide member 134. During such rotation, the cam follower 178 disengages the cam 174, as shown. Once the tool 210 is removed from the guide member 132, the biasing mechanism 180 will return the guide member to its initial location and cause the cam follower 178 to reengage the cam 174.

The limit surfaces 202, 204 thus establish an innermost limit distance from the belt 114 for the inwardly facing side of the tool. The belt 114 is routed such that, at this innermost limit distance, no contact occurs between the belt and the side of the tool apart from the sharpening zones adjacent the base surfaces 156, 158 (e.g., side surface 214). FIG. 11 demonstrates that no contact is made between the belt 114 and the side surface 214 of the tool 210 except proximate the cutting edge 216, thereby preventing inadvertent contact between the side surface and the abrasive member which could lead to scratching or other damage to the side of the tool.

The pivotal capability of the guide members 132, 134 relative to the guide frame 162 can also advantageously ensure light pressure is applied to the tool by a user during a sharpening operation. Should the user press down with too much force upon the presented tool, this force may overcome the bias force of the biasing mechanism 180 and cause the guide member to rotate outwardly as discussed above. This can thus serve as a good "training aid" to help the user maintain an appropriate level of force upon the tool and achieve greater repeatability during successive sharpening cycles.

It is contemplated that the abrasive belt 114 is mechanically unsupported on the backside of the abrasive belt in the vicinity of the sharpening operations along the respective planar extents 114A, 114B. This allows the belt to undergo controlled deflection, which can result in a superior sharpening operation.

Figure 12A:
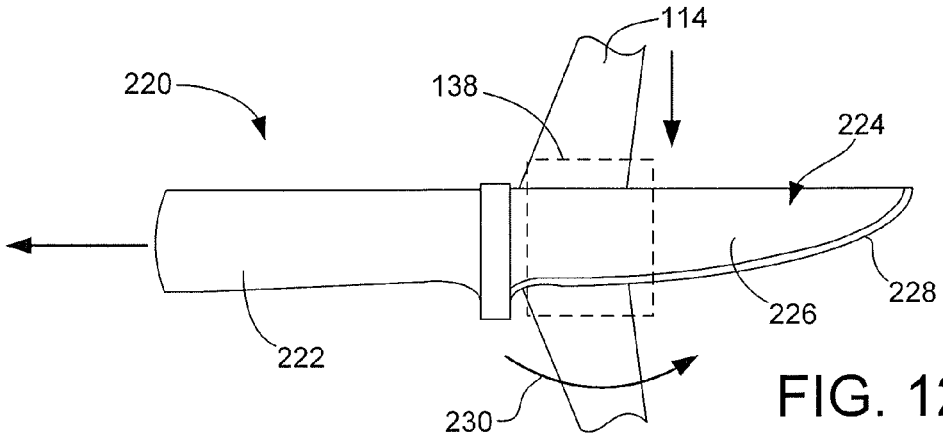
FIGS. 12A and 12B illustrate a first mode of deflection of the abrasive member of the sharpener of FIG. 1 during a sharpening operation on another exemplary cutting tool to conform to a shape of the cutting edge of the tool.
Figure 12B:
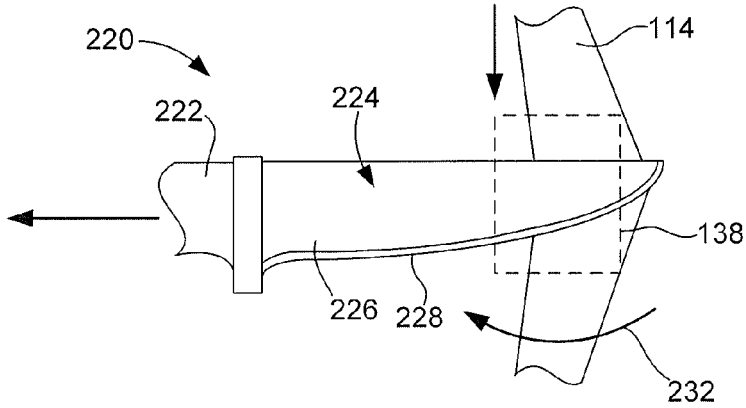

FIGS. 12A and 12B generally illustrate a first deflection mode of the abrasive belt 114 during sharpening using the tool sharpener 100 in accordance with some embodiments. An exemplary cutting tool (kitchen knife) 220 includes a handle 222, blade portion 224, side surface 226 and cutting edge 228. The abrasive belt 114 twists out of its normally aligned neutral plane, as indicated by torsion arrow 230, in the vicinity of the knife 220 as the cutting edge 228 is drawn across the belt. Generally, the moving belt 114 will undergo localized torsion (twisting) to maintain a nominally constant angle between the abrasive surface and the cutting edge 228.

In this way, a constant and consistent grinding plane can be maintained with respect to the blade material and shape. A first amount of torsion in a generally counter-clockwise direction occurs near the handle 222 (FIG. 12A), and a second amount of torsion in a generally clockwise direction (torsion arrow 232) occurs near the blade tip. These changes are induced responsive to changes in the curvilinearity of the cutting edge 228.

Figure 13A:
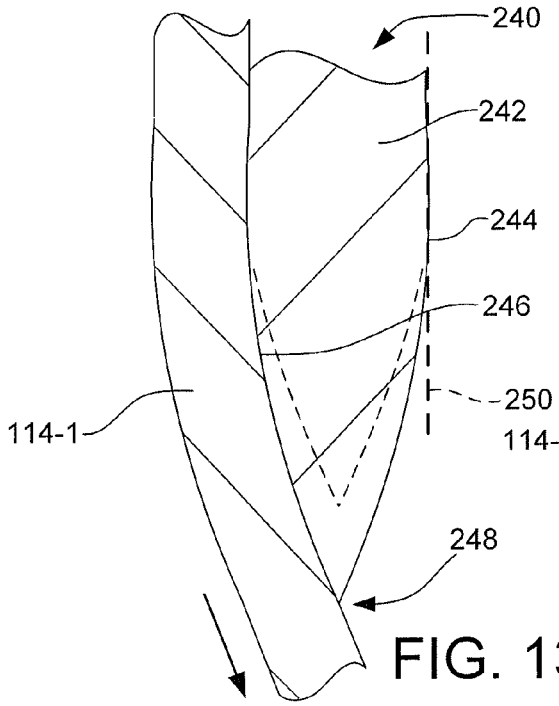
FIGS. 13A and 13B illustrate a second mode of deflection of the abrasive member of the sharpener of FIG. 1 during a sharpening operation on another exemplary cutting tool.
Figure 13B:
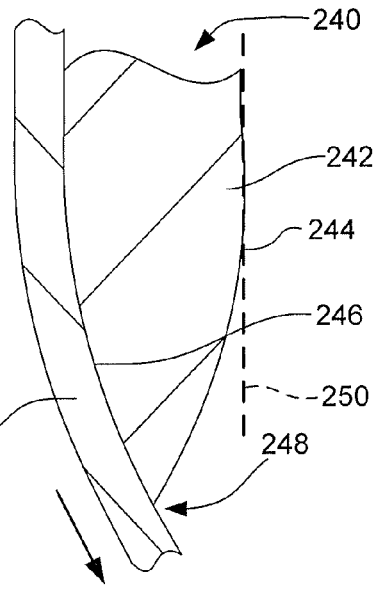

FIGS. 13A and 13B generally illustrate a second deflection mode of abrasive medium 114 during sharpening using the tool sharpener 100 in accordance with some embodiments. The sharpener 100 provides a convex grind surface geometry to a cutting tool (knife) 240. FIG. 13A shows a blade portion 242 of the knife with side surfaces 244, 246 and cutting edge 248. It will be appreciated that the side surface 244 is contactingly aligned against the associated guide surface of the stationary guide assembly 130 so that the side surface 244 is nominally aligned along guide plane 250. A portion of the opposing side surface 246 contactingly engages a first abrasive belt 114-1.

When alternately applied to opposing sides of the blade 242, the first abrasive medium 114-1 provides continuously extending, substantially convex surfaces along sides 244, 246 which converge and intersect to form the cutting edge 248. The first abrasive belt 114-1 has a relatively coarse abrasive level and relatively high linear stiffness characteristics.

FIG. 13B shows a subsequent grinding operation upon the blade portion 242 of the knife 240 a second abrasive belt 114-2. The second abrasive belt 114-2 has a relatively fine abrasive level and a relatively lower linear stiffness. This allows the second belt 114-2 to induce a smaller radius of curvature as compared to the first belt 114-1, providing the blade with a compound convex geometry that provides an extremely sharp final cutting edge 248.

It is contemplated in some embodiments that sharpening operations can be carried out as discussed above using a first belt such as 114-1 to provide a coarse grinding operation, followed by replacement of the first belt with a second belt such as 114-2 to provide a fine grinding (honing) operation. The rotatable edge guide 120 and adjustable sharpening guide assembly 130 can be used to provide support during these and other types of sharpening operations. As desired, different sharpening angles can be used; for example, sharpening using the first belt 114-1 can be carried out using an angle of about 20 degrees, and sharpening using the second belt 114-2 can be carried out using an angle of about 25 degrees. In other embodiments, the same angle is used for both belts.

While various embodiments have provided a dual stage guide assembly with opposing guide members 132 and 134, it will be appreciated that such is merely exemplary and is not limiting, so that the disclosed embodiments can be readily adapted to provide a single stage guide assembly, such as one configured with just guide member 132 (or 134), in a tool sharpening environment. Moreover, as noted above other forms of flexible abrasive media, such as but not limited to a flexible rotatable abrasive disc, etc., can be used. While moving media have been disclosed, other forms of media, such as stationary media, can be used as well.

It will now be appreciated that the various embodiments presented herein provide a number of benefits over the art. The use of a guide member pivotally mounted to a guide frame as discussed herein allows a guide surface to be selectively adjustable to a desired angle. A biasing mechanism as disclosed herein can maintain contact between a cam surface and a cam follower used to establish the guide angle while also permitting the angle to be selectively increased such as through the application of excessive force by the user or the attempted sharpening of a relatively wide blade at an insufficiently small sharpening angle.

While motor-driven powered sharpeners have been disclosed herein, such is merely exemplary and is not limiting. Any number of different types of sharpener configurations can employ the various features exemplified herein, including sharpeners that do not employ a motor-driven abrasive surface.

It is to be understood that even though numerous characteristics and advantages of various embodiments of the present disclosure have been set forth in the foregoing description, together with details of the structure and function of various embodiments thereof, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A tool sharpener for sharpening a cutting tool having a first side, an opposing second side and a cutting edge therebetween, the tool sharpener comprising:

a flexible abrasive medium having an abrasive surface and extending along a neutral plane to form a planar extent;

a guide assembly adjacent the planar extent of the medium, comprising:

a guide frame;

a cam surface selectively rotatable with respect to the guide frame;

a guide member pivotally mounted to the guide frame, the guide member having a guide surface extending along a guide plane at a selected angle with respect to the planar extent of the medium to support the first side of the tool during presentation of the second side and the cutting edge of the tool against the abrasive surface of the medium along the planar extent, the guide member further having a cam follower which contactingly engages the cam surface to establish the selected angle in relation to the selected position of the cam surface;

a biasing mechanism which applies a biasing force to urge the guide surface to pivot toward the planar extent to maintain the cam follower in contact with the cam surface; and a user activated knob coupled to the cam surface and configured to be rotated by a user to set the selected angle of the guide surface.

2. The tool sharpener of claim 1, wherein the guide surface is a first guide surface and the guide member further comprises a second guide surface in facing relation to the first guide surface and a base surface between the first and second guide surfaces to form a generally v-shaped channel to accommodate insertion of the tool therein.

3. The tool sharpener of claim 2, wherein the base surface is a stationary edge guide surface configured to contactingly support the cutting edge during said presentation of the cutting edge against the abrasive surface.

4. The tool sharpener of claim 1, wherein the guide frame comprises a limit surface maintained in a fixed position adjacent the planar extent of the abrasive medium and arranged in a facing relation to the guide surface of the guide member, wherein the limit surface is separated from the guide surface by a variable distance determined in relation to the selected angle of the guide surface, and wherein the limit surface is configured to contactingly support the first side of the tool to reduce contact between the first side of the tool and the abrasive surface along the planar extent of the medium.

5. The tool sharpener of claim 4, wherein the guide surface is a first guide surface and the guide member further comprises a second guide surface in facing relation to the first guide surface and separated therefrom by a fixed distance, wherein at a first selected angle the variable distance is less than the fixed distance and at a second, greater selected angle the variable distance is greater than the fixed distance.

6. The tool sharpener of claim 5, wherein the limit surface is nominally aligned with the second guide surface at a selected angle of about 20 degrees.

7. The tool sharpener of claim 1, wherein the flexible abrasive medium is an endless abrasive belt routed along a belt path supported by at least one roller to form the planar extent.

8. The tool sharpener of claim 7, wherein the belt path further comprises a second planar extent of the belt, the cam surface is a first cam surface, the guide member is a first guide member, the guide surface is a first guide surface and the cam follower is a first cam follower, and wherein the tool sharpener further comprises:

a second cam surface connected to the first cam surface for concurrent movement therewith with respect to the guide frame; and a second guide member pivotally mounted to the guide frame, the second guide member having a second guide surface extending along a second guide plane at the selected angle with respect to the second planar extent of the belt to support the second side of the tool during presentation of the first side and the cutting edge of the tool against the abrasive surface of the belt along the second planar extent, the second guide member further having a second cam follower which contactingly engages the second cam surface to establish the selected angle in relation to the selected position of the second cam surface;

wherein the biasing mechanism is connected between the first and second guide members to apply a second biasing force to urge the second guide surface toward the second planar extent to maintain the second cam follower in contact with the second cam surface.

9. The tool sharpener of claim 8, wherein each of the first and second cam surfaces are connected to a user activated knob rotatable by a user to establish the selected angle.

10. The tool sharpener of claim 8, wherein the biasing mechanism is a coiled spring having a first end connected to a first leg portion of the first guide member and a second end connected to a second leg portion of the second guide member.

11. The tool sharpener of claim 10, wherein the first guide member pivots about a first pivot point, the second guide member pivots about a second pivot point, and wherein the first and second pivot points are respectively located between the coiled spring and the respective first and second cam followers.

12. The tool sharpener of claim 1, further comprising a rotatable edge guide adjacent the guide member having a roller member which rotates about an edge guide roller axis orthogonal to the planar extent of the abrasive medium, the roller member configured to support via rolling contact the cutting edge of the tool during presentation thereof against the abrasive surface.

13. A tool sharpener for sharpening a cutting tool having a first side, a second side opposite the first side, a cutting edge between the first and second sides and a top edge opposite the cutting edge, the tool sharpener comprising:

a base structure which encloses an electric motor;

an endless abrasive belt coupled to the electric motor for rotational movement along a belt path routed over at least one roller to provide a planar extent of the abrasive belt, the endless abrasive belt having an outer abrasive surface;

a guide assembly adjacent the planar extent of the belt, comprising:

a guide frame;

a cam surface selectively positionable with respect to the guide frame;

a guide member pivotally mounted to the guide frame, the guide member having a guide surface extending along a guide plane at a selected angle with respect to the planar extent of the belt to support the first side of the tool during presentation of the second side and the cutting edge of the tool against the abrasive surface of the belt along the planar extent, the guide member further having a cam follower which contactingly engages the cam surface to establish the selected angle in relation to the selected position of the cam surface; and a biasing mechanism which applies a biasing force to urge the guide surface to pivot toward the planar extent to maintain the cam follower in contact with the cam surface.

14. The tool sharpener of claim 13, wherein the guide frame comprises a limit surface maintained in a fixed position adjacent the planar extent of the belt and arranged in a facing relation to the guide surface of the guide member, wherein the limit surface is separated from the guide surface by a variable distance determined in relation to the selected angle of the guide surface, and wherein the limit surface is configured to contactingly support the first side of the tool to reduce contact between the first side of the tool and the abrasive surface along the planar extent of the belt.

15. The tool sharpener of claim 14, wherein the guide surface is a first guide surface and the guide member further comprises a second guide surface in facing relation to the first guide surface and separated therefrom by a fixed distance, wherein at a first selected angle the variable distance is less than the fixed distance and at a second, greater selected angle the variable distance is greater than the fixed distance.

16. The tool sharpener of claim 13, wherein the cam surface is coupled to a user activated knob configured to be rotated by a user to set the selected angle of the guide surface.

17. The tool sharpener of claim 13, wherein the guide surface is a first guide surface, the guide member further comprises a second guide surface in facing relation to the first guide surface and a base surface between the first and second guide surfaces to form a generally v-shaped channel to accommodate insertion of the tool therein, the base surface comprising a stationary edge guide to support the cutting edge of the tool during said presentation.

18. A tool sharpener for sharpening a cutting tool having a first side, an opposing second side and a cutting edge therebetween, the tool sharpener comprising:

a flexible abrasive medium having an abrasive surface and extending along a neutral plane to form a planar extent;

a guide assembly adjacent the planar extent of the medium, comprising:

a guide frame;

a cam surface selectively positionable with respect to the guide frame;

a guide member pivotally mounted to the guide frame, the guide member having a first guide surface extending along a guide plane at a selected angle with respect to the planar extent of the medium to support the first side of the tool during presentation of the second side and the cutting edge of the tool against the abrasive surface of the medium along the planar extent, the guide member further having a cam follower which contactingly engages the cam surface to establish the selected angle in relation to the selected position of the cam surface, the guide member further comprising a second guide surface in facing relation to the first guide surface and a base surface between the first and second guide surfaces to form a generally v-shaped channel to accommodate insertion of the tool therein; and a biasing mechanism which applies a biasing force to urge the first guide surface to pivot toward the planar extent to maintain the cam follower in contact with the cam surface.

19. A tool sharpener for sharpening a cutting tool having a first side, an opposing second side and a cutting edge therebetween, the tool sharpener comprising:

a flexible abrasive medium having an abrasive surface and extending along a neutral plane to form a planar extent;

a guide assembly adjacent the planar extent of the medium, comprising:

a guide frame;

a cam surface selectively positionable with respect to the guide frame;

a guide member pivotally mounted to the guide frame, the guide member having a guide surface extending along a guide plane at a selected angle with respect to the planar extent of the medium to support the first side of the tool during presentation of the second side and the cutting edge of the tool against the abrasive surface of the medium along the planar extent, the guide member further having a cam follower which contactingly engages the cam surface to establish the selected angle in relation to the selected position of the cam surface;

a biasing mechanism which applies a biasing force to urge the guide surface to pivot toward the planar extent to maintain the cam follower in contact with the cam surface; and an edge guide adjacent the guide member configured to support the cutting edge of the tool during presentation thereof against the abrasive surface.

20. The tool sharpener of claim 19, wherein the edge guide is characterized as a rotatable edge guide adjacent the guide member having a roller member which rotates about an edge guide roller axis orthogonal to the planar extent of the abrasive medium, the roller member configured to support via rolling contact the cutting edge of the tool during presentation thereof against the abrasive surface.

* * * * *